US008214946B2

(12) United States Patent
Reeb et al.

(10) Patent No.: US 8,214,946 B2
(45) **Date of Patent: *Jul. 10, 2012**

(54) PORTABLE HAMMOCK AND HAMMOCK FRAME

(75) Inventors: David Reeb, Columbia, MD (US); Paul Robinette, Phoenix, AZ (US)

(73) Assignee: Swimways Corporation, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/084,960

(22) Filed: Apr. 12, 2011

(65) Prior Publication Data

US 2011/0185496 A1 Aug. 4, 2011

Related U.S. Application Data

(63) Continuation of application No. 12/182,624, filed on Jul. 30, 2008, now Pat. No. 7,926,129.

(51) Int. Cl.
*A45F 3/24* (2006.01)
*A45F 3/22* (2006.01)

(52) U.S. Cl. ..... 5/129; 5/127

(58) Field of Classification Search ..... 5/129, 127, 5/120, 122, 123

See application file for complete search history.

(56) References Cited

U.S. PATENT DOCUMENTS

| | | | |
|---|---|---|---|
| 7,712 | A | 10/1850 | Whitmarsh |
| 221,754 | A | 11/1879 | Travers |
| 314,986 | A | 4/1885 | Aenis |
| 342,668 | A | 5/1886 | Woodbury |
| 369,546 | A | 9/1887 | Nickerson |
| 381,025 | A | 4/1888 | Parmelee |
| 398,943 | A | 3/1889 | Crandall |
| 416,242 | A | 12/1889 | Sutphen |
| 468,576 | A | 2/1892 | Palmer |
| 469,869 | A | 3/1892 | Palmer |
| 506,776 | A | 10/1893 | Ford |
| 531,727 | A | 1/1895 | Keegan, Sr. et al. |
| 540,041 | A | 5/1895 | Blomberg |

(Continued)

FOREIGN PATENT DOCUMENTS

DE 1 958 083 A1 7/1970

(Continued)

OTHER PUBLICATIONS

Advertisement for the "Easy Foldable Hammock," 1 page.

(Continued)

*Primary Examiner* — Robert G Santos
(74) *Attorney, Agent, or Firm* — Cooley LLP

(57) ABSTRACT

In one embodiment, a frame has an expanded configuration and a collapsed configuration. The frame includes a support member that has a first end portion and a second end portion opposite the first end portion. The first end portion of the first elongate member is pivotally coupled to the second end portion of the support member. A second elongate member has a first end portion and a second end portion opposite the first end portion. The first end portion of the second elongate member is pivotally coupled to the support member. A third elongate member has a first end portion and a second end portion. The first end portion of the third elongate member is pivotally coupled to the second end portion of the second elongate member. The third elongate member is pivotally coupled to the second end portion of the first elongate member.

20 Claims, 13 Drawing Sheets

U.S. PATENT DOCUMENTS

| | | | | |
|---|---|---|---|---|
| 604,942 | A | 5/1898 | Palmer | |
| 631,747 | A | 8/1899 | Lloyd | |
| 699,410 | A | 5/1902 | Palmer | |
| 717,119 | A | 12/1902 | Potter | |
| 817,534 | A | 4/1906 | Troselj | |
| 862,346 | A | 8/1907 | Pihlblad et al. | |
| 904,006 | A | 11/1908 | Oberg | |
| 998,761 | A | 7/1911 | Engstrand | |
| 1,097,100 | A | 5/1914 | Kallio | |
| 1,120,234 | A | 12/1914 | Palmer | |
| 1,151,495 | A | 8/1915 | Menten | |
| 1,176,963 | A | 3/1916 | Howell | |
| 1,185,568 | A | 5/1916 | Zeunert | |
| 1,224,782 | A | 5/1917 | Pedersen | |
| 1,312,299 | A | 8/1919 | Almen | |
| 1,367,955 | A | 2/1921 | Finstrom | |
| 1,480,591 | A | 1/1924 | Bakesef et al. | |
| 1,693,564 | A | 11/1928 | Murphy et al. | |
| 1,732,008 | A | 10/1929 | Frantz | |
| 1,758,721 | A | 5/1930 | Swartz et al. | |
| 1,788,919 | A | 1/1931 | Lansberry et al. | |
| 1,917,518 | A | 7/1933 | Goudie | |
| 2,503,508 | A | 4/1950 | Parks | |
| 2,581,623 | A | 1/1952 | Benjamin | |
| 3,086,740 | A | 4/1963 | Hatton | |
| 3,593,352 | A | 7/1971 | Britt | |
| 4,229,845 | A | 10/1980 | de Cuadros | |
| 4,384,379 | A | 5/1983 | Yamada | |
| D274,390 | S | 6/1984 | Shakas | |
| 4,691,394 | A | 9/1987 | Woo | |
| D295,242 | S | 4/1988 | Frick et al. | |
| 4,757,563 | A | 7/1988 | An | |
| 4,826,241 | A | 5/1989 | Barras | |
| 4,925,138 | A | 5/1990 | Rawlins | |
| 4,951,332 | A | 8/1990 | Barmettler | |
| 5,003,652 | A | 4/1991 | Bayless | |
| 5,046,203 | A | 9/1991 | de Cuadros | |
| D342,841 | S | 1/1994 | Campanello | |
| 5,392,476 | A * | 2/1995 | Williams | 5/127 |
| 5,414,873 | A | 5/1995 | Wolf | |
| 5,636,392 | A | 6/1997 | Choi | |
| 5,655,235 | A | 8/1997 | DeAth | |
| 5,659,907 | A | 8/1997 | Huang | |
| 5,715,552 | A | 2/1998 | DeAth | |
| 5,718,473 | A | 2/1998 | Lynch, Jr. | |
| 5,740,570 | A | 4/1998 | Hsieh | |
| D408,166 | S | 4/1999 | Bayless | |
| D411,387 | S | 6/1999 | Zheng | |
| 5,913,772 | A | 6/1999 | Clark | |
| 5,983,422 | A | 11/1999 | Bayless | |
| 5,984,406 | A | 11/1999 | Lee | |
| 6,003,173 | A | 12/1999 | Meoli et al. | |
| D425,722 | S | 5/2000 | Hennessy | |
| 6,082,813 | A | 7/2000 | Chen | |
| 6,112,757 | A | 9/2000 | Tseng | |
| 6,134,727 | A | 10/2000 | Hwang | |
| 6,170,907 | B1 | 1/2001 | Tsai | |
| 6,179,374 | B1 | 1/2001 | Tang | |
| 6,276,008 | B1 | 8/2001 | Chen | |
| 6,314,594 | B1 | 11/2001 | Meoli et al. | |
| 6,364,410 | B1 | 4/2002 | Tang | |
| 6,402,230 | B1 | 6/2002 | Tang | |
| 6,418,577 | B1 | 7/2002 | Murphy | |
| 6,446,282 | B1 | 9/2002 | Wu | |
| 6,454,348 | B1 | 9/2002 | Wu | |
| 6,457,192 | B2 | 10/2002 | Choi et al. | |
| 6,467,109 | B1 | 10/2002 | Wu | |
| 6,470,518 | B1 | 10/2002 | Ke | |
| 6,564,402 | B1 | 5/2003 | Lin | |
| 6,629,722 | B1 | 10/2003 | Tang | |
| 6,711,761 | B2 | 3/2004 | Choi | |
| 6,763,534 | B2 | 7/2004 | Hwang | |
| D498,088 | S | 11/2004 | Tsang | |
| 6,925,664 | B1 | 8/2005 | Twigg | |
| 6,931,679 | B1 | 8/2005 | Tseng | |
| 6,966,084 | B2 | 11/2005 | Le Gette et al. | |
| 7,089,610 | B2 | 8/2006 | Zhong | |
| 7,114,205 | B2 | 10/2006 | Choi | |
| 7,272,865 | B2 | 9/2007 | Le Gette et al. | |
| 7,334,837 | B1 | 2/2008 | Long | |
| 7,395,561 | B2 | 7/2008 | Le Gette et al. | |
| 7,406,726 | B2 | 8/2008 | Deng | |
| 7,441,287 | B2 | 10/2008 | Zheng | |
| 7,509,695 | B2 | 3/2009 | Zheng | |
| 7,571,499 | B2 | 8/2009 | Le Gette et al. | |
| 7,926,129 | B2 * | 4/2011 | Reeb et al. | 5/129 |
| 2001/0054198 | A1 | 12/2001 | Choi et al. | |
| 2004/0000009 | A1 | 1/2004 | Choi | |
| 2004/0034929 | A1 | 2/2004 | Hwang | |
| 2004/0206861 | A1 | 10/2004 | Le Gette et al. | |
| 2005/0060802 | A1 | 3/2005 | Zhong | |
| 2005/0188460 | A1 | 9/2005 | O'Brien | |
| 2005/0246836 | A1 | 11/2005 | Wu | |
| 2006/0070180 | A1 | 4/2006 | Le Gette et al. | |
| 2006/0150325 | A1 | 7/2006 | Zheng | |
| 2006/0282948 | A1 | 12/2006 | Deng | |
| 2007/0209113 | A1 | 9/2007 | Le Gette et al. | |
| 2008/0256703 | A1 | 10/2008 | Le Gette et al. | |
| 2009/0064415 | A1 | 3/2009 | Payne et al. | |
| 2010/0024124 | A1 * | 2/2010 | Reeb et al. | 5/129 |
| 2010/0287700 | A1 * | 11/2010 | Reeb et al. | 5/127 |
| 2011/0185496 | A1 * | 8/2011 | Reeb et al. | 5/129 |

FOREIGN PATENT DOCUMENTS

| | | |
|---|---|---|
| DE | 28 53 993 A1 | 7/1980 |
| DE | 201 10 262 U1 | 9/2001 |
| IT | 697011 | 11/1972 |
| WO | WO 86/05081 | 9/1986 |

OTHER PUBLICATIONS

Advertisement for the "Folding Hammock-Padded Reversible" and the "Heavenly Slumber Hammock," 1 page.
Advertisement for the "Hide-Away Hammock", 1 page.
International Search Report for PCT Application No. PCT/US04/11852 mailed on Nov. 29, 2006, 4 pages.

* cited by examiner

PORTABLE HAMMOCK AND HAMMOCK FRAME

CROSS-REFERENCE TO RELATED APPLICATIONS

This application is a continuation of U.S. patent application Ser. No. 12/182,624 entitled "Portable Hammock and Hammock Frame," filed Jul. 30, 2008, now U.S. Pat. No. 7,926,129, the disclosure of which is hereby incorporated by reference in its entirety.

BACKGROUND

This invention relates generally to a support having multiple configurations, and in particular, to a support, such as a hammock support, that can be disposed in an expanded configuration and in a collapsed configuration.

Known hammocks and hammock supports can be used to support a user. Such hammocks and hammock supports are often transported and used in various outdoor settings, such as in a backyard or at a campground. Known hammocks and hammock supports, however, are typically difficult to transport because of their size and weight. Such known hammocks typically have only an expanded configuration or a non-compact collapsed configuration and, thus, can be large (e.g., large depth and width) and difficult to transport.

A need, therefore, exists for a hammock and hammock support that can be easily converted from an expanded configuration to a collapsed configuration and easily transported from one location to another.

SUMMARY OF THE INVENTION

In one embodiment, a frame has an expanded configuration and a collapsed configuration. The frame includes a support member that has a first end portion and a second end portion opposite the first end portion. The first end portion of the first elongate member is pivotally coupled to the second end portion of the support member. A second elongate member has a first end portion and a second end portion opposite the first end portion. The first end portion of the second elongate member is pivotally coupled to the support member. A third elongate member has a first end portion and a second end portion. The first end portion of the third elongate member is pivotally coupled to the second end portion of the second elongate member. The third elongate member is pivotally coupled to the second end portion of the first elongate member. The third elongate member is substantially parallel to a support surface when the frame is in its expanded configuration. The support member and the first elongate member are substantially parallel to the second elongate member when the frame is in the collapsed configuration.

In another embodiment, a frame has an expanded configuration and a collapsed configuration. The frame is substantially U-shaped when the frame is in the expanded configuration and viewed from a side. The frame includes an elongate member having a first side portion and a second side portion opposite the first side portion. A first connection member is pivotally coupled to the first side portion of the elongate member. A second connection member is pivotally coupled to the second side portion of the elongate member. A first support member is pivotally coupled to the first connection member. The first support member is configured to couple to a hammock member. The second support member is pivotally coupled to the second connection member. The second support member is configured to couple to the hammock member. The first support member is substantially parallel to the second support member when the frame is in the collapsed configuration.

In yet another embodiment, a frame has an expanded configuration and a collapsed configuration. The frame includes a first end portion that has a first support member and a second support member. The first end portion has a connection member pivotally coupled to the first support member such that the connection member is disposed between the first support and the second support member. The first end portion is configured to removably couple to a hammock member. The frame includes a second end portion that has a first support member and a second support member. The second portion has a connection member pivotally coupled to the first support member of the second end portion such that the first support member of the second end portion is disposed between the connection member of the second end portion and the second support member of the second end portion. The second end portion being configured to removably couple to the hammock member. The first support member is parallel to the second support member when the frame is in the collapsed configuration.

BRIEF DESCRIPTION OF THE DRAWINGS

The present invention is described with reference to the accompanying drawings.

DETAILED DESCRIPTION

A support device includes a frame that can be disposed in an expanded configuration and in a collapsed configuration. The frame is self-supporting when disposed in its expanded configuration. The frame is compact and easily transportable when disposed in its collapsed configuration. The frame has a first end portion, a second end portion, a first side portion and a second side portion. The frame includes multiple elongate members disposed in a substantially parallel arrangement when the frame is its collapsed configuration. The support device described herein can be placed on a support surface, such as, for example a floor. The support device is configured to support a user when the frame is in the expanded configuration.

Figure 1:
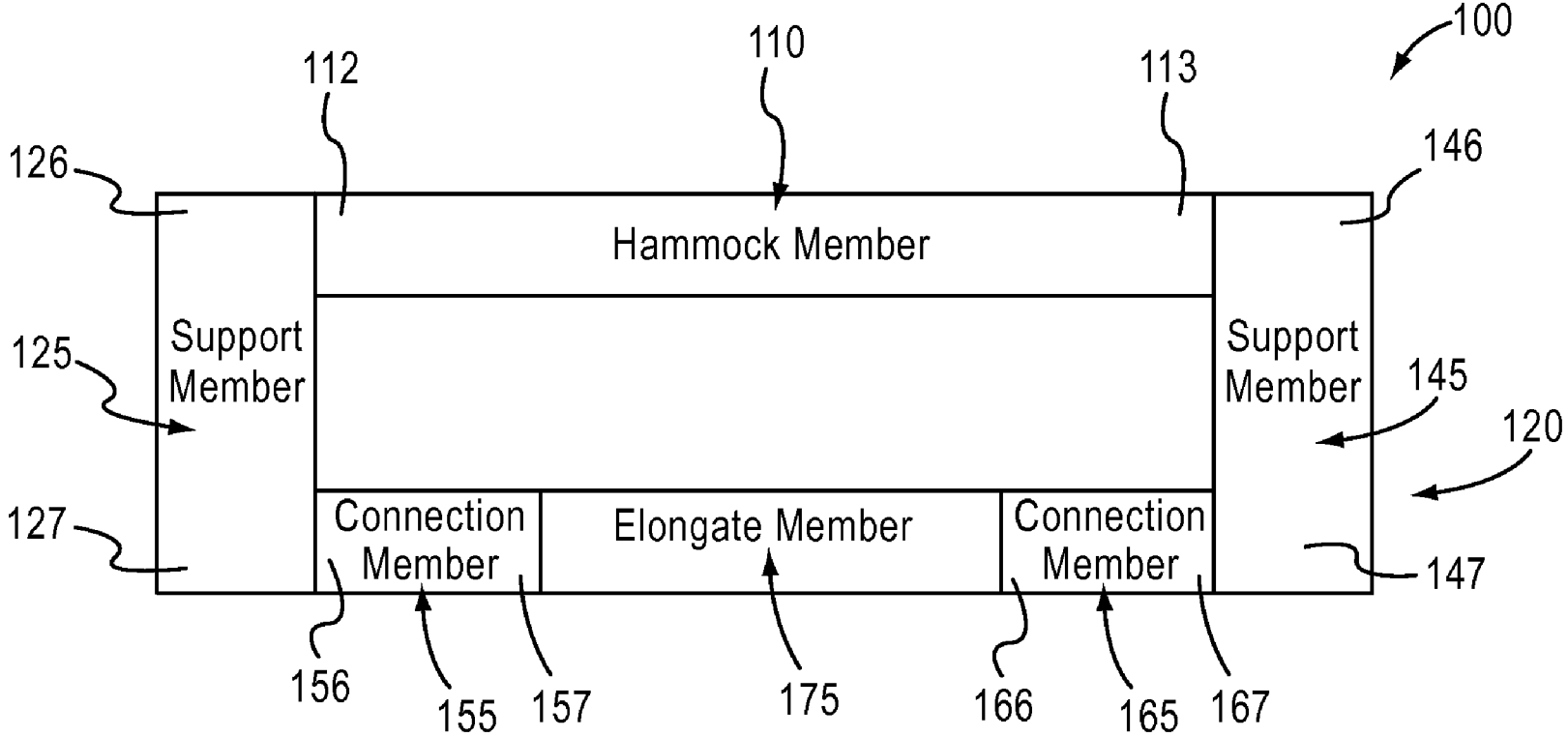
FIG. 1 is a schematic illustration of a support according to an embodiment of the invention.

FIG. 1 is a schematic illustration of a support device according to an embodiment of the invention. As shown in FIG. 1, an apparatus 100 (also referred herein as a "support") includes a hammock member 110 and a frame 120.

The frame 120 includes a first support member 125, a second support member 145, a first connection member 155, a second connection member 165 and an elongate member 175. The first support member 125 has a first end portion 126 and a second end portion 127 opposite the first end portion 126. The second support member 145 has a first end portion 146 and a second end portion 147 opposite the first end portion 146. The first connection member 155 has a first end portion 156 and a second end portion 157 opposite the first end portion 156. The first end portion 156 of the first connection member 155 is pivotally coupled to the second end portion 127 of the first support member 125. The second end portion 157 of the first connection member 155 is pivotally coupled to the elongate member 175. The second connection member 165 has a first end portion 166 and a second end portion 167 opposite the first end portion 166. The first end portion 166 of the second connection member 165 is pivotally coupled to the elongate member 175. The second end portion 167 of the second connection member 165 is pivotally coupled to the second end portion 147 of the second support member 145.

The hammock member 110 is removably coupled to the frame 120. Specifically, a first end portion 112 of the hammock member 120 is removably coupled to the first support member 125 of the frame 120. A second end portion 113 of the hammock member 110 is coupled to the second support member 145 of the frame 120.

The frame 120 has an expanded configuration and a collapsed configuration. The frame 120 is substantially U-shaped when the frame is in the expanded configuration and viewed from a side. The frame 120 can support the hammock member 110 and a user of the support disposed on the hammock member 110 when the frame 120 is in the expanded configuration. The elongate member 175 can be disposed substantially parallel to a support surface (not illustrated) when the frame 120 is in its expanded configuration.

The frame 120 can move between the expanded configuration and the collapsed configuration. Specifically, the first connection member 155 can pivot with respect to the first support member 125 and the elongate member 175. The second connection member 165 can pivot with respect to the second support member 145 and the elongate member 175. The first support member 125, the second support member 145, the first connection member 155, the second connection member 165 and the elongate member 175 can be substantially parallel to one another when the frame 120 is in the collapsed configuration.

Figure 2:
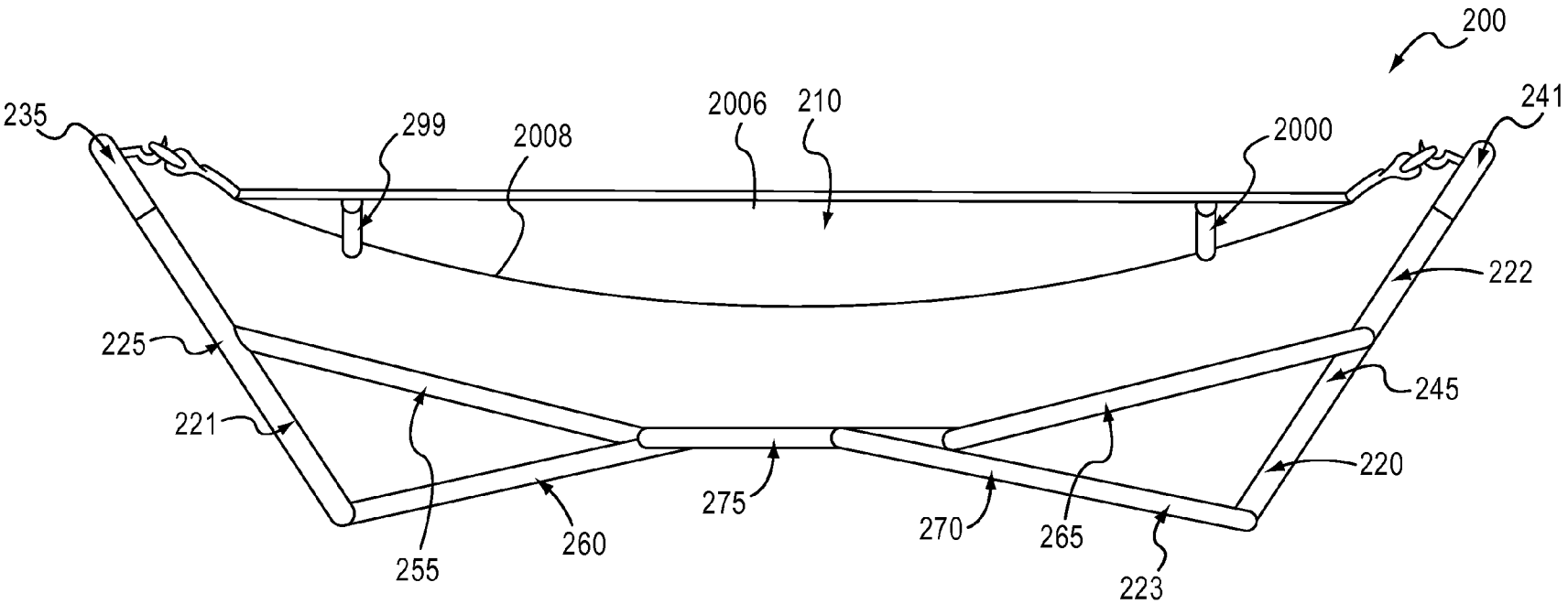
FIG. 2 is a side view of a support according to an embodiment of the invention.

FIG. 2 illustrates an apparatus or support 200 in an expanded or deployed configuration, according to an embodiment of the invention. In one embodiment, the support 200, in its expanded configuration, can be used as a hammock. The support 200 includes a frame 220 and a hammock member 210 coupled to the frame 220. The frame 220 has a first end portion 221 and a second end portion 222 opposite the first end portion 221, which are coupled together by a first side portion 223 and a second side portion 224 (see FIG. 4) opposite the first side portion 223.

Figure 4:
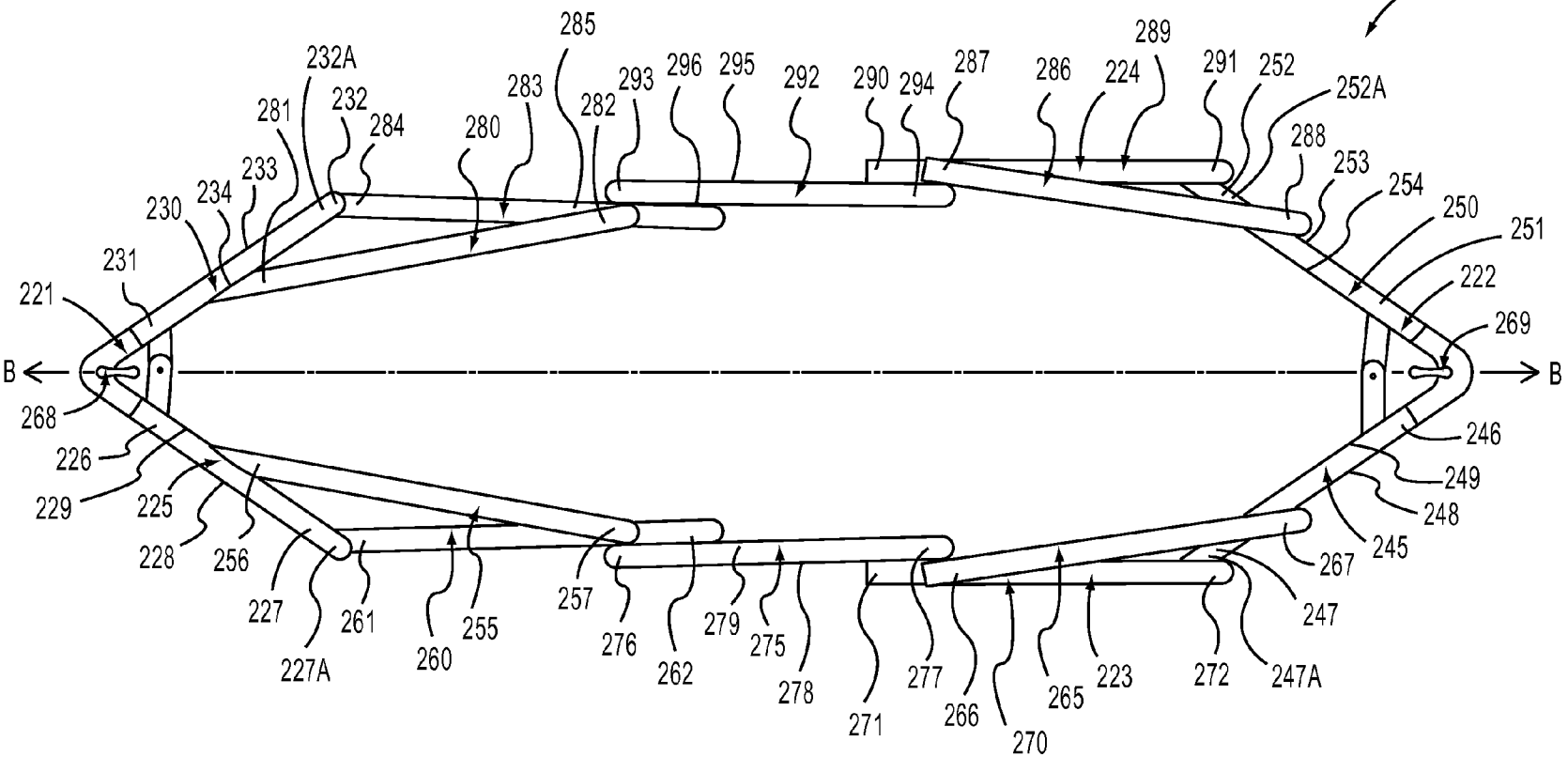
FIG. 4 is a top view of the frame of FIG. 3 disposed in an expanded configuration.
Figure 4A:
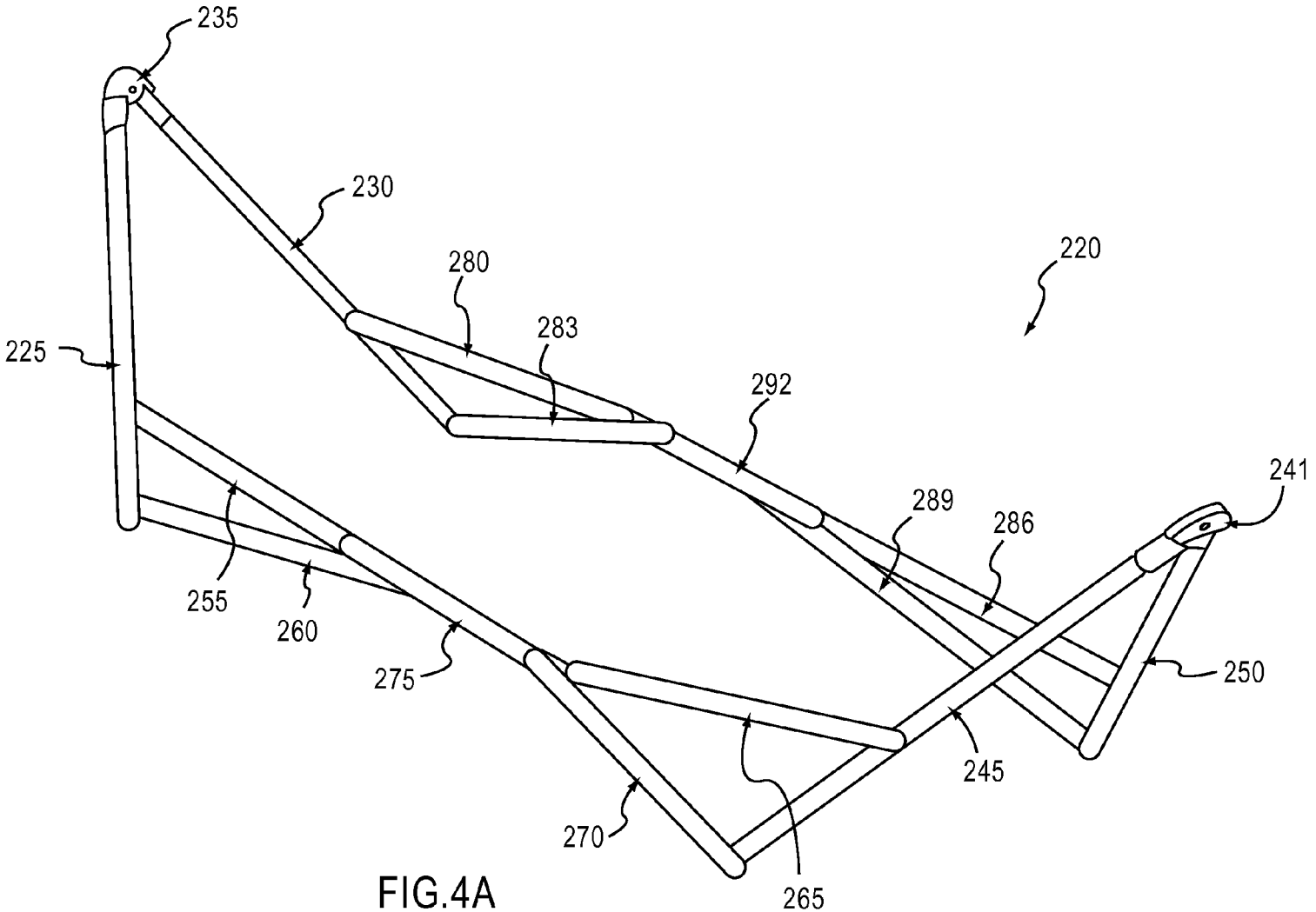
FIG. 4A is a perspective view of the frame of FIG. 3 disposed in an expanded configuration.
Figure 5:
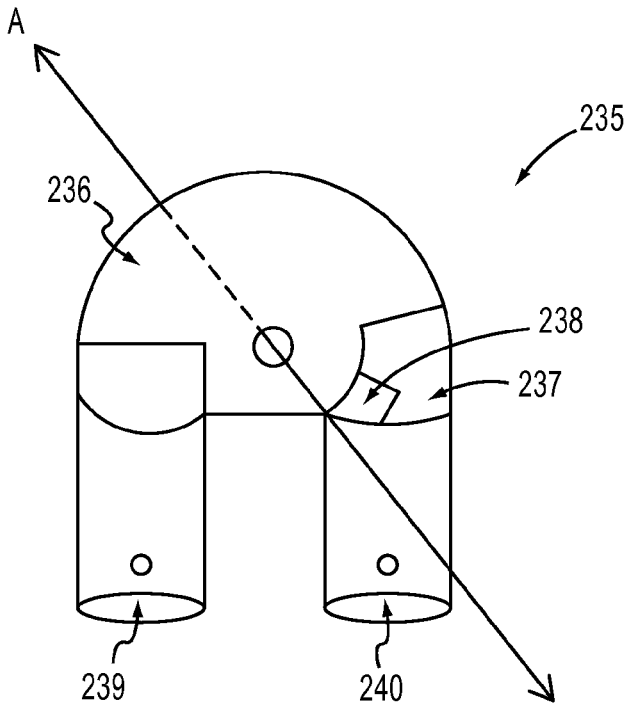
FIG. 5 is a side view of a coupler disposed in a closed configuration, according to an embodiment of the invention.
Figure 9:
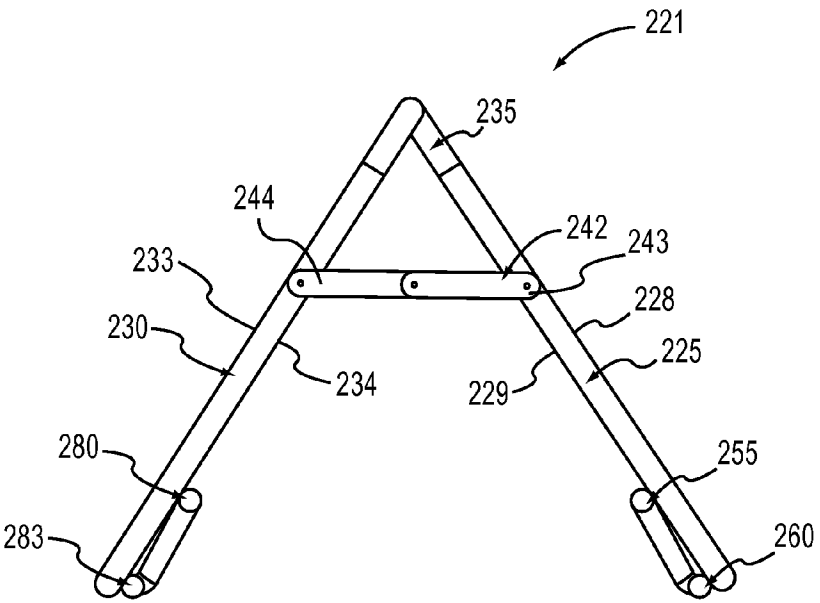
FIG. 9 is an end view of the frame of FIG. 3 disposed in an open configuration.
Figure 11:
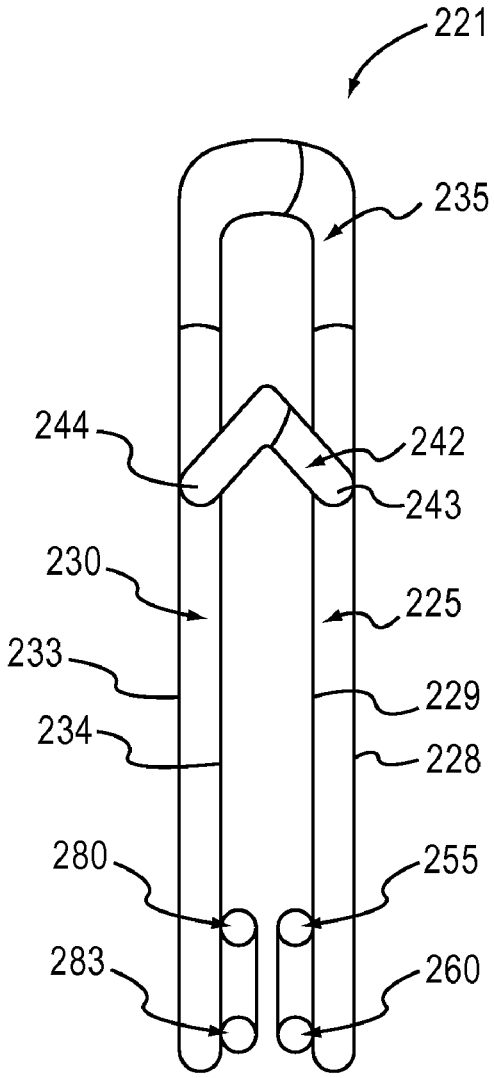
FIG. 11 is an end view of the frame of FIG. 3 disposed in a closed configuration.

In the illustrated embodiment, the first end portion 221 includes a first support member 225 and a second support member 230 as shown in FIGS. 4 and 4A. The first support member 225 is coupled to the second support member 230 such that the first support member 225 pivots, or moves, with respect to the second support member 230 from an open configuration to a closed configuration as shown in FIGS. 9 and 11, respectively. Specifically, the first support member 225 of the first end portion 221 has a first end portion 226 and a second end portion 227 opposite the first end portion 226. The first end portion 226 of the first support member 225 is coupled to a first coupler 235. Similarly, the second support member 230 has a first end portion 231 and a second end portion 232 opposite the first end portion 231. The first end portion 231 of the second support member 230 is coupled to the first coupler 235.

As illustrated in FIGS. 5-8, the first coupler 235 includes a first connection portion 236 and a second connection portion 237. The first connection portion 236 is coupled to the first end portion 226 of the first support member 225. The second connection portion 237 is coupled to the first end portion 231 of the second support member 230. The first connection portion 236 and the second connection portion 237 are pivotally coupled via any appropriate means, such as a nut and bolt, a pin, a rivet, or a brad. Therefore, the first coupler 235 is configured to bend or pivot about an axis A, thereby allowing the first support member 225 to pivot or move with respect to the second support member 230.

Figure 6:
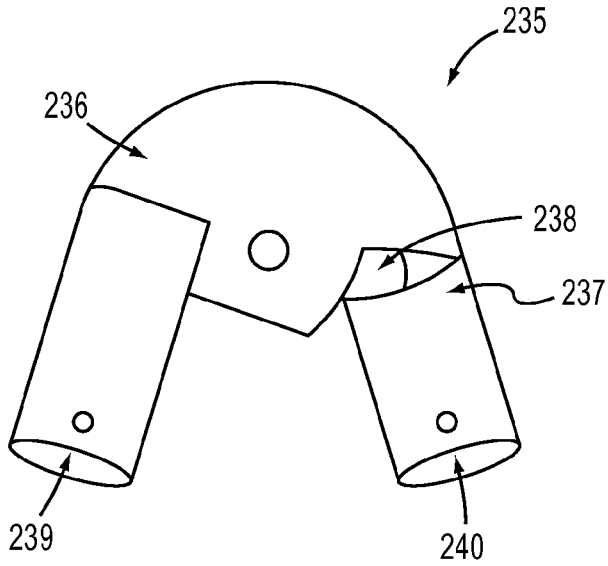
FIG. 6 is a side view of the coupler disposed in a open configuration, according to an embodiment of the invention.
Figure 7:
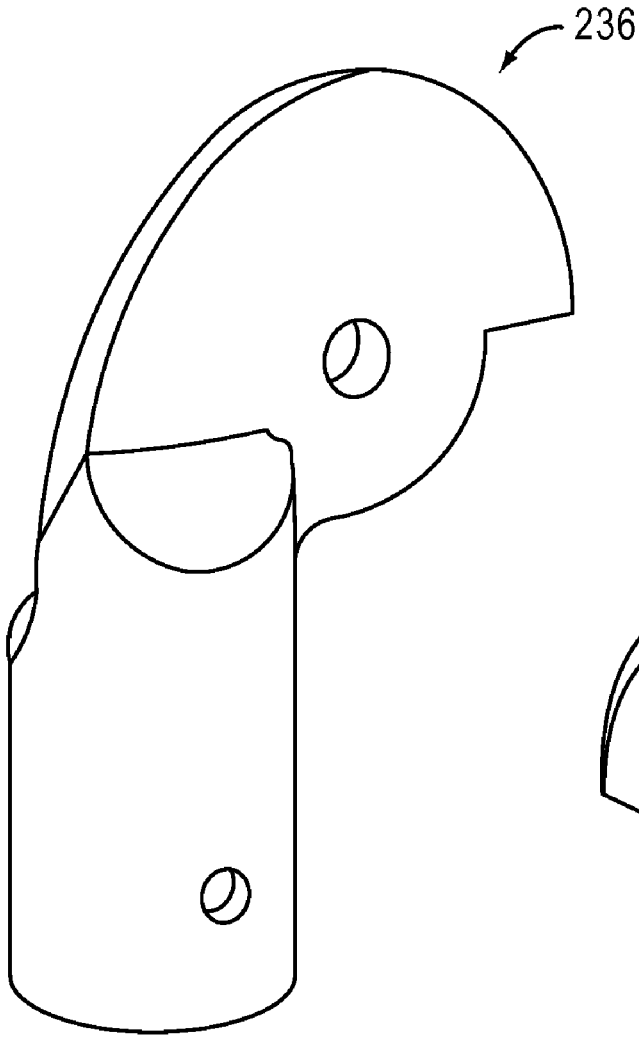
FIG. 7 is a side perspective view of a portion of the coupler of FIG. 5.
Figure 8:
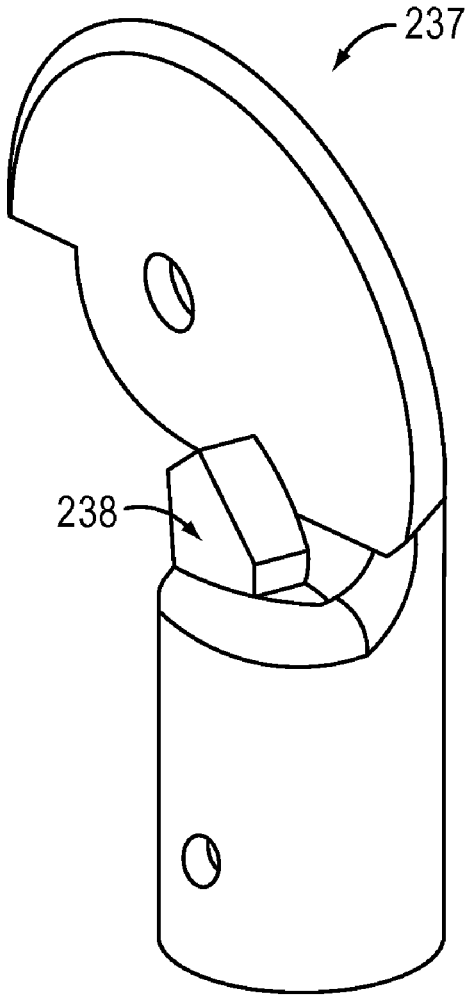
FIG. 8 is a side perspective view of another portion of the coupler of FIG. 5.

In the illustrated embodiment, the second connection portion 237 of the first coupler 235 includes a protrusion 238. The protrusion 238 is sized such that the first support member 225 and the second support member 230 are prevented from over-pivoting with respect to each other. For example, as the first support member 225 is pivoted away from the second support member 230, the protrusion 238 moves toward the first connection portion 236 of the first coupler 235. As best illustrated in FIG. 6, the protrusion 238 contacts the first connection portion 236 when the first support member 225 and the second support member 230 are pivoted with respect to each other to an open configuration. The contact between the protrusion 238 and the first connection portion 236 prevents the first support member 225 and the second support member 230 from being pivoted or moved beyond the open configuration.

In some embodiments, the first coupler includes several protrusions. For example, in one embodiment, the first connection portion and the second connection portion may include protrusions that are sized to contact another portion of the first coupler when the support members of the first end portion of the frame are pivoted to an open configuration.

In the illustrated embodiment, a portion of the first support member 225 and a portion of the second support member 230 are received by openings 239 and 240 of the first coupler 235, respectively.

In one embodiment, the support members are coupled to the coupler via an adhesive, such as glue. In alternative embodiments, the support members are coupled to the coupler via a screw, a rivet, a pin, or any other coupling mechanism. In a further alternative embodiment, the support members are fit into the openings of the coupler, respectively, and are retained via friction. Although the first support member and the second support member are illustrated as being coupled to the coupler at their ends, respectively, the support members need not be coupled to the coupler at their ends.

In an alternative embodiment, the first end portion of the frame does not include a coupler. Rather, the first support member of the first end portion is pivotally coupled to the second support member of the first end portion via a rivet, a nut and bolt, a pin, or any other type of pivoting joint. In another alternative embodiment, the first support member of the first end portion is fixedly coupled to the second support member of the first end portion, and the support members of the first end portion are not configured to pivot with respect to each other.

In another alternative embodiment, the first support member of the first end portion and the second support member of the first end portion are not coupled to one another. For example, the first support member of the first end portion and the second support member of the first end portion are substantially parallel to one another when the frame is in the collapsed and expanded configuration.

As shown in FIGS. 9 and 11, the first end portion 221 of the frame 220 includes a first cross member 242 having a first end portion 243 and a second end portion 244 opposite the first end portion 243. The first end portion 243 of the first cross member 242 is pivotally coupled to the first support member 225. The second end portion 244 of the first cross member 242 is pivotally coupled to the second support member 230. The first end portion 243 of the first cross member 242 is configured to pivot with respect to the second end portion 244 of the first cross member 242. The first cross member 242 has a non-linear configuration, as shown in FIG. 11, and a linear configuration, as shown in FIG. 9. The first end portion 243 of the first cross member 242 is pivoted with respect to the second end portion 244 of the first cross member 242 when the first cross member 242 is in the non-linear configuration (e.g., a bent or collapsed configuration). The first cross member 242 is disposed in its non-linear configuration when the frame 220 is in its collapsed configuration. The first cross member 242 contributes to the first coupler 235 maintaining the open configuration and, as a result, contributes to the frame 220 maintaining its expanded configuration when the first cross member 242 is in its linear configuration (e.g., a straight or expanded configuration).

Figure 10:
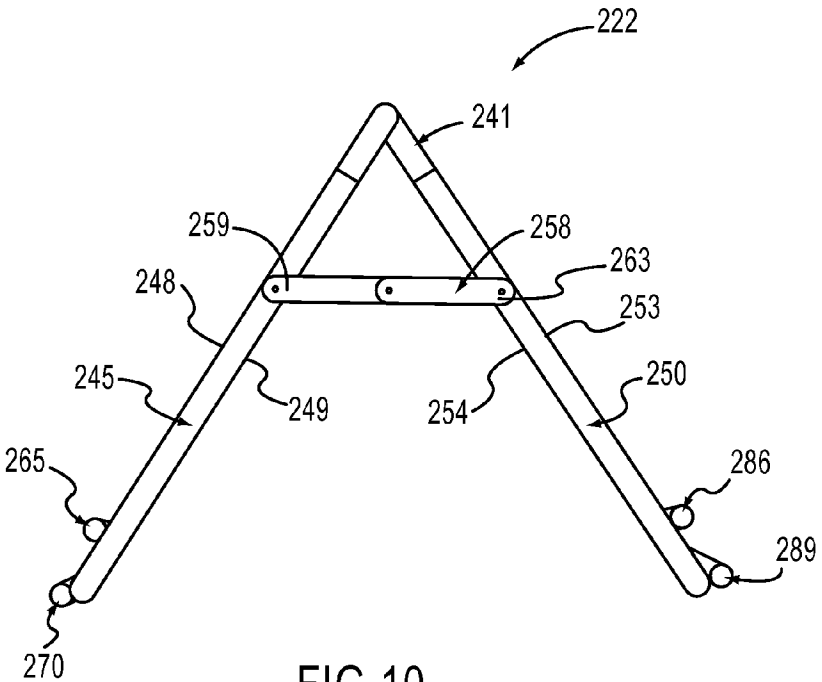
FIG. 10 is another end view of the frame of FIG. 3 disposed in an open configuration.
Figure 12:
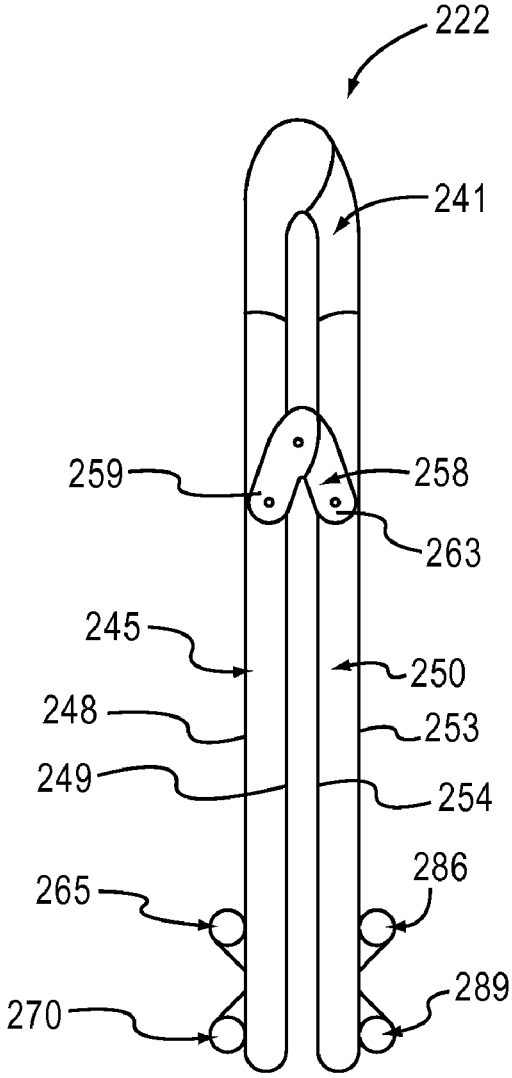
FIG. 12 is another end view of the frame of FIG. 3 disposed in a closed configuration.

As shown in FIGS. 4 and 4A, the second end portion 222 includes a first support member 245 and a second support member 250. The first support member 245 is coupled to the second support member 250 such that the first support member 245 pivots, or moves, with respect to the second support member 250 from an open configuration to a closed configuration as shown in FIGS. 10 and 12, respectively. Specifically, the first support member 245 has a first end portion 246 and second end portion 247 opposite the first end portion 246. The first end portion 246 of the first support member 245 is coupled to a second coupler 241. Similarly, the second support member 250 has a first end portion 251 and a second end portion 252 opposite the first end portion 251. The first end portion 251 of the second support member 250 is coupled to the second coupler 241. The second coupler 241 is similar to the first coupler 235 in structure and function.

In an alternative embodiment, the second end portion of the frame does not include the second coupler. Rather, the first support member of the second end portion is pivotally coupled to the second support member of the second end portion via a rivet, a nut and bolt, a pin, or any other type of pivoting joint. In another alternative embodiment, the first support member of the second end portion is fixedly coupled to the second support member of the second end portion, and the support members of the second end portion are not configured to pivot with respect to each other.

As shown in FIGS. 10 and 12, the second end portion 222 of the frame 220 includes a second cross member 258 having a first end portion 259 and a second end portion 263 opposite the first end portion 259. The first end portion 259 of the second cross member 258 is pivotally coupled to the first support member 245. The second end portion 263 of the second cross member 258 is pivotally coupled to the second support member 250. The first end portion 259 of the second cross member 258 is configured to pivot with respect to the second end portion 263 of the second cross member 258. The second cross member 258 has a non-linear configuration, as shown in FIG. 12, and a linear configuration, as shown in FIG. 10. The first end portion 259 of the second cross member 258 is pivoted with respect to the second end portion 263 when the second cross member 258 is in the non-linear configuration (e.g., a bent or collapsed configuration). The second cross member 258 is disposed in its non-linear configuration when the frame 220 is in its collapsed configuration. The second cross member 258 contributes to the second coupler 241 maintaining the open configuration and, as a result, contributes to the frame 220 maintaining its expanded configuration when the second cross member 258 is in its linear configuration (e.g., a straight or expanded configuration).

In an alternative embodiment, the first support member of the second end portion and the second support member of the second end portion are not coupled to one another. For example, the first support member of the second end portion and the second support member of the second end portion are substantially parallel to one another when the frame is in the collapsed or expanded configuration.

As best illustrated in FIGS. 2, 4 and 4A, the first side portion 223 includes multiple connection members 255, 260, 265 and 270, the first support member 225 of the first end portion 221 of the frame 220, the first support member 245 of the second end portion 222 of the frame 220 and an elongate member 275. Specifically, the first side portion 223 has a first connection member 255, a second connection member 260, a third connection member 265, a fourth connection member 270, the first support member 225 of the first end portion 221 of the frame 220, the first support member 245 of the second end portion 222 of the frame 220 and the elongate member 275.

In the illustrated embodiment, the elongate member 275 has a first end portion 276 and a second end portion 277 opposite the first end portion 276. The elongate member 275 also has a first side portion 278 and a second side portion 279 opposite the first side portion 278.

As shown in FIG. 4, the first support member 225 of the first end portion 221 and the first support member 245 of the second end portion 222 have a first side portion 228 and 248 (e.g., an outer side portion), respectively. The first support member 225 of the first end portion 221 and the first support member 245 of the second end portion 222 have a second side portion 229 and 249 (e.g., an inner side portion) opposite the first side portion 228 and 248, respectively.

In the illustrated embodiment, the first connection member 255 has a first end portion 256 and a second end portion 257 opposite the first end portion 256. The first end portion 256 of the first connection member 255 is pivotally coupled to the first support member 225 of the first end portion 221 along the second side portion 229 of the first support member 225 of the first end portion 221. Accordingly, the first connection member 255 can pivot or move with respect to the first support member 225 of the first end portion 221. The second end portion 257 of the first connection member 255 is pivotally coupled to the first end portion 276 of the elongate member 275. The second end portion 257 of the first connection member 255 is pivotally coupled to the elongate member 275 along the second side portion 279 of the elongate member 275. Accordingly, the first connection member 225 can pivot or move with respect to the elongate member 275.

In the illustrated embodiment, the second connection member 260 has a first end portion 261 and a second end portion 262 opposite the first end portion 261. The first end portion 261 of the second connection member 260 is pivotally coupled to the second end portion 227 of the first support member 225 of the first end portion 221. The first end portion 261 of the second connection member 260 is pivotally coupled to the first support member 225 of the first end portion 221 along the second side portion 229 of the first support member 225 of the first end portion 221. Accordingly, the second connection member 260 can pivot or move with respect to the first support member 225 of the first end portion 221. The second end portion 262 of the second connection member 260 is pivotally coupled to the elongate member 275 along the second side portion 279 of the elongate member 275. Accordingly, the second connection member 260 can pivot or move with respect to the elongate member 275.

In the illustrated embodiment, the third connection member 265 has a first end portion 266 and a second end portion 267 opposite the first end portion 266. The first end portion 266 of the third connection member 265 is pivotally coupled to the second end portion 277 of the elongate member 275. The first end portion 266 of the third connection member 265 is pivotally coupled to the elongate member 275 along the first side portion 278 of the elongate member 275. Accordingly, the third elongate member 265 can pivot or move with respect to the elongate member 275. The second end portion 267 of the third connection member 265 is pivotally coupled to the first support member 245 of the second end portion 222 along the first side portion 248 of the first support member 245 of the second end portion 222. Accordingly, the third connection member 265 can pivot or move with respect to the first support member 245 of the second end portion 222.

In the illustrated embodiment, the fourth connection member 270 has a first end portion 271 and a second end portion 272 opposite the first end portion 271. The first end portion 271 of the fourth connection member 270 is pivotally coupled to the elongate member 275 along the first side portion 278 of the elongate member 275. Accordingly, the fourth connection member 270 can pivot or move with respect to the elongate member 275. The second end portion 272 of the fourth connection member 270 is pivotally coupled to the first support member 245 of the second end portion 222 along the second end portion 247 of the first support member 245 of the second end portion 222. The second end portion 272 of the fourth connection member 270 is pivotally coupled to the first support member 245 of the second end portion 222 along the first side portion 248 of the first support member 245 of the second end portion 222. Accordingly, the fourth connection member 270 can pivot or move with respect to the first support member 245 of the second end portion 222.

In the illustrated embodiment, any member that is pivotally coupled to another member can be coupled via a nut and bolt, a rivet, or a pin that extends through at least a portion of one member and through at least a portion of the other member. In alternative embodiments, other connection mechanisms, such as, for example, brads, hinges, or any other type of pivoting joints, are used to couple a member to another member. In some embodiments, a first member can be adjacent to or in contact with a second member when the first member is coupled to the second member along a side of the second member.

The frame 220 defines an axis B as shown in FIG. 4. The first connection member 255 and the second connection member 260 are disposed between at least a portion of the first support member 225 of the first end portion 221 and the axis B as well as between at least a portion of the elongate member 275 and the axis B. At least a portion of the elongate member 275 and at least a portion of the first support member 245 of the second end portion 222 are disposed between the third connection member 265 and the axis B as well as between the fourth connection member 270 and the axis B. In an alternative embodiment, at least a portion of the first support member of the first end portion can be disposed between the first connection member and the axis B. At least a portion of the first support member of the first end portion can be disposed between the second connection member and the axis B. In another alternative embodiment, the elongate member can be disposed between the first connection member and the axis B. The elongate member can be disposed between the fourth connection member and the axis B. In yet another alternative embodiment, at least a portion of the third connection member and at least a portion of the fourth connection member can be disposed between the first support member of the second end portion and the axis B. In yet another alternative embodiment, at least a portion of the third connection member and at least a portion of the fourth connection member can be disposed between the elongate member and the axis B.

As best illustrated in FIG. 4, the second side portion 224, which is a mirror of the first side portion 223 and includes similar components, includes multiple connection members 280, 283, 286 and 289, the second support member 230 of the first end portion 221 of the frame 220, the second support member 250 of the second end portion 222 of the frame 220 and an elongate member 292. Specifically, the second side portion 224 has a first connection member 280, a second connection member 283, a third connection member 286, a fourth connection member 289, the second support member 230 of the first end portion 221 of the frame 220, the second support member 250 of the second end portion 222 of the frame 220 and the elongate member 292.

In the illustrated embodiment, the elongate member 292 has a first end portion 293 and a second end portion 294 opposite the first end portion 293. The elongate member 292 also has a first side portion 295 and a second side portion 296 opposite the first side portion 295.

In the illustrated embodiment, the second support member 230 of the first end portion 221 and the second support member 250 of the second end portion 222 have a first side portion 233 and 253 and a second side portion 234 and 254 opposite the first side portion 233 and 253, respectively.

In the illustrated embodiment, the first connection member 280 has a first end portion 281 and a second end portion 282 opposite the first end portion 281. The first end portion 281 of the first connection member 280 is pivotally coupled to the second support member 230 of the first end portion 221 along the second side portion 234 of the second support member 230 of the first end portion 221. Accordingly, the first connection member 280 can pivot or move with respect to the second support member 230 of the first end portion 221. The second end portion 282 of the first connection member 280 is pivotally coupled to the first end portion 293 of the elongate member 292. The second end portion 282 of the first connection member 280 is pivotally coupled to the elongate member 292 along the second side portion 296 of the elongate member 292. Accordingly, the first connection member 280 can pivot or move with respect to the elongate member 292.

In the illustrated embodiment, the second connection member 283 has a first end portion 284 and a second end portion 285 opposite the first end portion 284. The first end portion 284 of the second connection member 283 is pivotally coupled to the second support member 230 of the first end portion 221 along the second end portion 232 of the second support member 230 of the first end portion 221. The first end portion 284 of the second connection member 283 is pivotally coupled to the second side portion 234 of the second support member 230 of the first end portion 221. Accordingly, the second connection member 283 can pivot or move with respect to the second support member 230 of the first end portion 221. The second end portion 285 of the second connection member 283 is pivotally coupled to the elongate member 292 along the second side portion 296 of the elongate member 292. Accordingly, the second connection member 293 can pivot or move with respect to the elongate member 292.

In the illustrated embodiment, the third connection member 286 has a first end portion 287 and a second end portion 288 opposite the first end portion 287. The first end portion 287 of the third connection member 286 is pivotally coupled to the second end portion 294 of the elongate member 292. The first end portion 287 of the third connection member 286 is pivotally coupled to the elongate member 292 along the first side portion 295 of the elongate member 292. Accordingly, the third elongate member 286 can pivot or move with respect to the elongate member 292. The second end portion 288 of the third connection member 286 is pivotally coupled to the second support member 250 of the second end portion 222 along the first side portion 253 of the second support member 250 of the second end portion 222. Accordingly, the third connection member 286 can pivot or move with respect to the second support member 250 of the second end portion 222.

In the illustrated embodiment, the fourth connection member 289 has a first end portion 290 and a second end portion 291 opposite the first end portion 290. The first end portion 290 of the fourth connection member 289 is pivotally coupled to the elongate member 292 along the first side portion 295 of the elongate member 292. Accordingly, the fourth connection member 289 can pivot or move with respect to the elongate member 292. The second end portion 291 of the fourth connection member 289 is pivotally coupled to the second end portion 252 of the second support member 250 of the second end portion 222. The second end portion 291 of the fourth connection member 289 is pivotally coupled to the second support member 250 of the second end portion 222 along the first side portion 253 of the second support member 250 of the second end portion 222. Accordingly, the fourth connection member 289 can pivot or move with respect to the second support member 250 of the second end portion 222.

In the illustrated embodiment, any member that is pivotally coupled to another member can be coupled via a nut and bolt, a rivet, or a pin that extends through at least a portion of one member and through at least a portion of the other member. In alternative embodiments, other connection mechanisms, such as, for example, brads, hinges, or any other type of pivoting joints, are used to couple a member to another member.

The first connection member 280 and the second connection member 283 are disposed between at least a portion of the second support member 230 of the first end portion 221 and the axis B as well as disposed between the elongate member 292 and the axis B. The elongate member 292 and the second support member 250 of the second end portion 222 are disposed between the third connection member 286 and the axis B as well as disposed between at least a portion of the fourth connection member 289 and the axis B. In an alternative embodiment, at least a portion of the second support member of the first end portion can be disposed between the first connection member of the second side portion and the axis B. At least a portion of the second support member of the first end portion can be disposed between the second connection member of the second side portion and the axis B. In another alternative embodiment, the elongate member of the second side portion can be disposed between the first connection member of the second side portion and the axis B. The elongate member of the second side portion can be disposed between the fourth connection member of the second side portion and the axis B. In yet another alternative embodiment, at least a portion of the third connection member of the second side portion and at least a portion of the fourth connection member of the second side portion can be disposed between the second support member of the second end portion and the axis B. In yet another alternative embodiment, at least a portion of the third connection member of the second side portion and at least a portion of the fourth connection member of the second side portion can be disposed between the elongate member of the second side portion and the axis B.

In the illustrated embodiment, the support members 225, 230, 245 and 250, the elongate members 275 and 292 and the connection members 255, 260, 265, 270, 280, 283, 286 and 289 are hollow, metal tubes, such as steel tubes. Alternatively, these members can be formed of any material and configured in any cross-sectional shape that provides sufficient structural strength to support a user. For example, the support members 225, 230, 245 and 250 can be aluminum tubes, plastic tubes, or solid metal or plastic bars. These support members can have a square cross-section, a circular cross-section, a rectangular cross-section, or the like.

Figure 3:
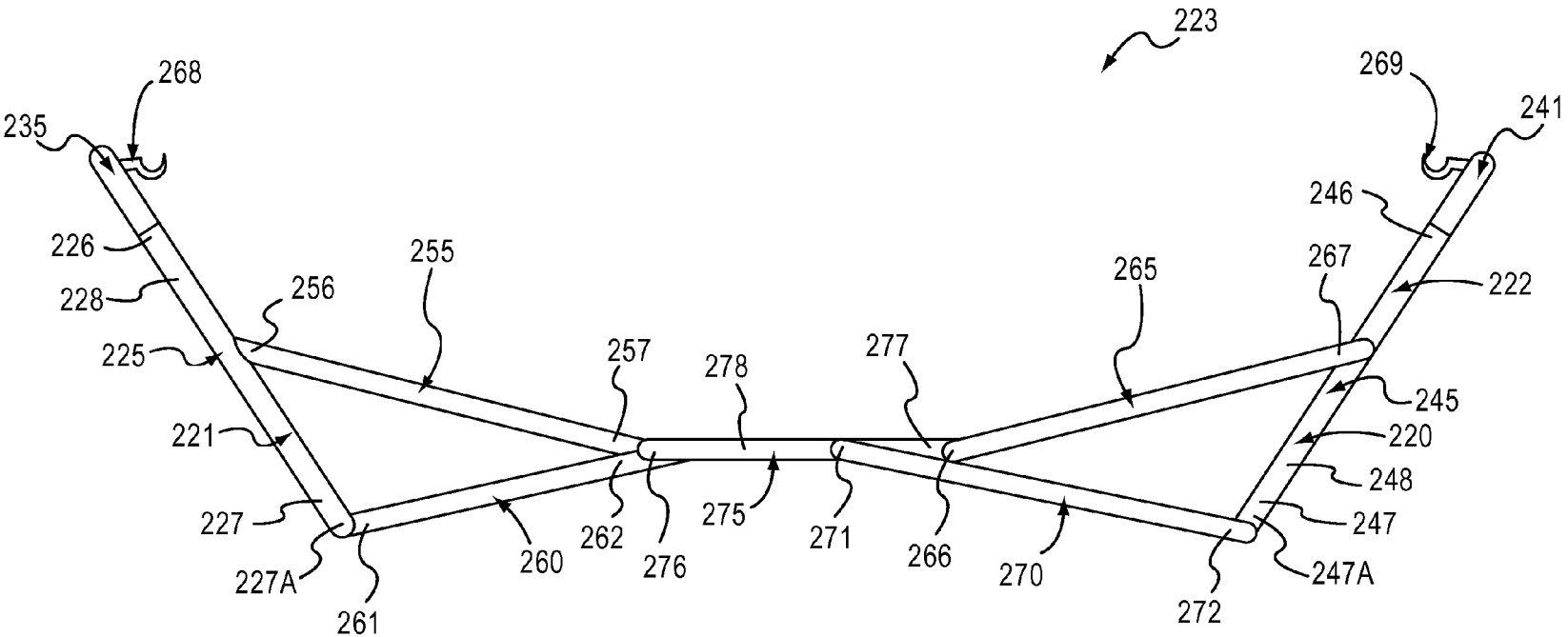
FIG. 3 is a side view of a frame of the support of FIG. 2 disposed in an expanded configuration.

Referring back to the first end portion 221 and the second end portion 222 of the frame 220, as discussed above, FIGS. 9 and 11 are end views of the of the frame 220 of FIG. 3 disposed in the open configuration and the closed configuration, respectively. The first and second connection members 255 and 260 of the first side portion 223 are pivotally coupled to the first support member 225 of the first end portion 221 along the second side portion 229 (e.g., an inner side portion) of the first support member 225 of the first end portion 221. Similarly, the first and second connection members 280 and 283 of the second side portion 224 are pivotally coupled to the second support member 230 of the first end portion 221 the second side portion 234 (e.g., an inner side portion) of the second support member 230 of the first end portion 221. In other words, the connection members 255, 260, 280 and 283 are disposed between the first support member 225 and the second support member 230 of the first end portion 221. In an alternative embodiment, the connection members can be coupled to the outer side portions of the first and second support members of the first end portion of the frame.

As discussed above, FIGS. 10 and 12 are second end views of the of the frame 220 of FIG. 3 disposed in the open configuration and the closed configuration, respectively. The third and fourth connection members 265 and 270 of the first side portion 223 are pivotally coupled to the first support member 245 of the second end portion 222 along the first side portion 248 (e.g., an outer side portion) of the first support member 245 of the second end portion 222. Similarly, the third and fourth connection members 286 and 289 of the second side portion 224 are pivotally coupled to the second support member 250 of the second end portion 222 along the first side portion 253 (e.g., an outer side portion) of the second support member 250 of the second end portion 222. In other words, the first support member 245 and the second support member 250 of the second end portion 222 are disposed between the third and fourth connection members 265 and 270 of the first side portion 223 and the third and fourth connection member 286 and 289 of the second side portion 224. In an alternative embodiment, the connection members can be coupled to the inner side portions of the first and second support members of the first end portion of the frame.

Figure 15:
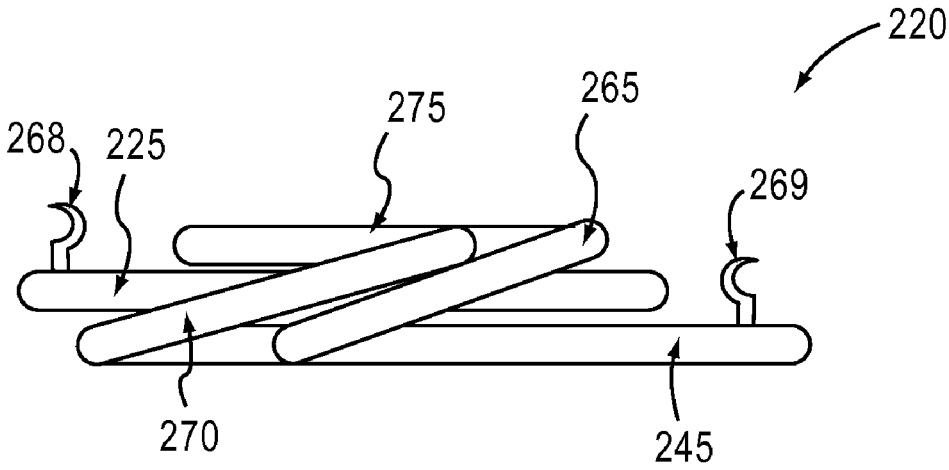
FIG. 15 is a side view of the frame of FIG. 3 disposed in a collapsed configuration.
Figure 16:
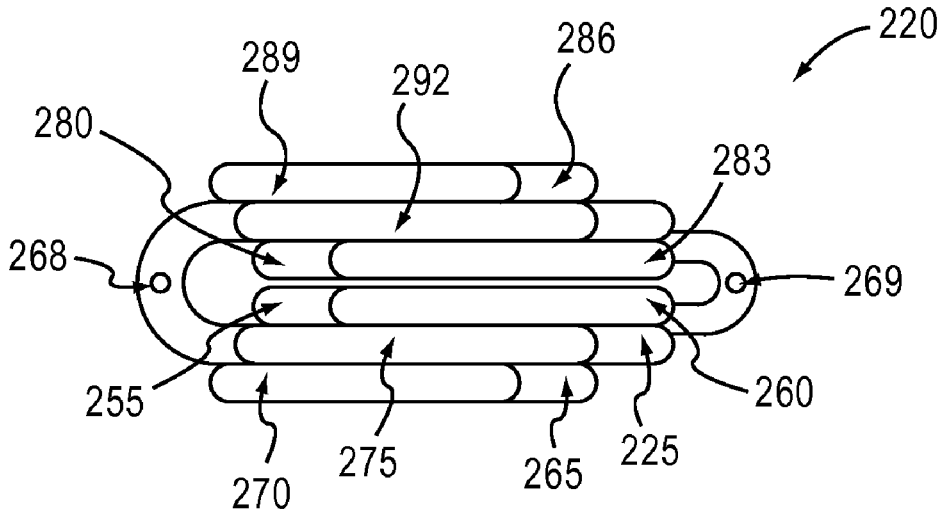
FIG. 16 is a top view of the frame of FIG. 3 disposed in a collapsed configuration.

The frame 220 is movable between a collapsed configuration as shown in FIGS. 15 and 16 and an expanded configuration as shown in FIGS. 3 and 4. The frame 220 is substantially W-shaped when the frame 220 is in the expanded configuration and viewed from a side (as illustrated in FIG. 3). The elongate members 275 and 292 are substantially parallel to a support surface when the frame 220 is in the expanded configuration. The frame 220 remains in its expanded configuration when it is placed in such configuration until converted to its collapsed configuration. In other words, the frame 220 is self-supporting when in the expanded configuration without the need for external forces to maintain the frame 220 in the expanded configuration. The cross members 242 and 258 contribute to the frame 220 remaining in the expanded configuration when the frame 220 is placed in such configuration. In some embodiments, the frame is substantially U-shaped or has a slanted U-shape when viewed from a side.

As best illustrated in FIGS. 3, 4 and 4A, when the frame 220 is disposed in its expanded configuration, the first end portion 221 and the second end portion 222 are slanted with respect to each other. In other words, the first end portion 221 and the second end portion 222 are disposed in a non-parallel relationship and a non-perpendicular relationship when the frame 220 is disposed in its expanded configuration. In the illustrated embodiment, the distance between the first coupler 235 and the second coupler 241 is greater than the distance between an end 227A of the second end portion 227 of the first support member 225 of the first end portion 221 and an end 247A of the second end portion 247 of the first support member 245 of the second end portion 222. Similarly, the distance between the first coupler 235 and the second coupler 241 is greater than the distance between an end 232A of the second end portion 232 of the second support member 230 of the first end portion 221 and an end 252A of the second end portion 252 of the second support member 250 of the second end portion 222. Additionally, when the frame 220 is in its expanded configuration, the support members 225 and 230 of the first end portion 221 are pivoted or moved apart from each other (e.g., they are in their open configuration). Similarly, when the frame 220 is in its expanded configuration, the support members 245 and 250 of the second end portion 222 are pivoted or moved apart from each other (e.g., they are in their open configuration).

As best illustrated in FIGS. 15 and 16, when the frame 220 is in its collapsed configuration, the support members 225, 230, 245 and 260, the elongate members 275 and 292 and the connection members 255, 260, 265, 270, 280, 283, 286 and 289 are substantially parallel to each other. In other words, they are closer to being parallel than they are to being perpendicular.

As best illustrated in FIGS. 13-16, the frame 220 may be converted from the expanded configuration to the collapsed configuration. To convert the frame 220 from its expanded configuration to its collapsed configuration, the first side portion 223 of the frame 220 and the second side portion 224 of the frame 220 are moved together. Specifically, the support members 225, 230, 245 and 260 are moved from the open configuration to the closed configuration as illustrated in FIGS. 11 and 12. For example, the first support member 225 of the first end portion 221 may be pivoted towards the second support member 230 of the first end portion 221. The first support member 245 of the second end portion 222 may be pivoted towards the second support member 250 of the second end portion 222. In a step of converting the frame 220 from its expanded configuration to its collapsed configuration, the first and second cross members 242 and 258 are moved from their linear configuration to their non-linear configuration.

Figure 13:
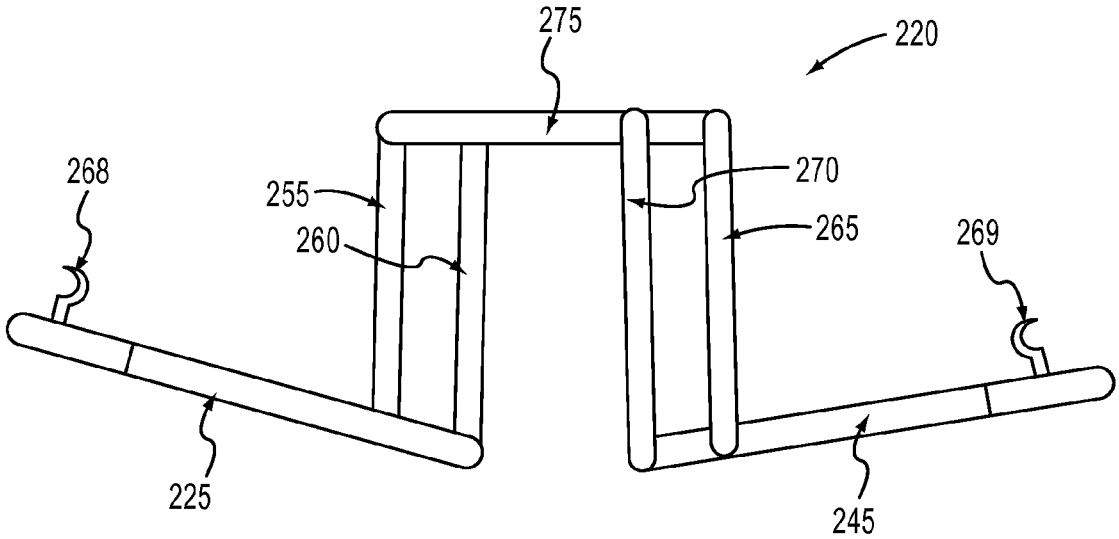
FIGS. 13 and 14 are side views of the frame of FIG. 3.
Figure 14:
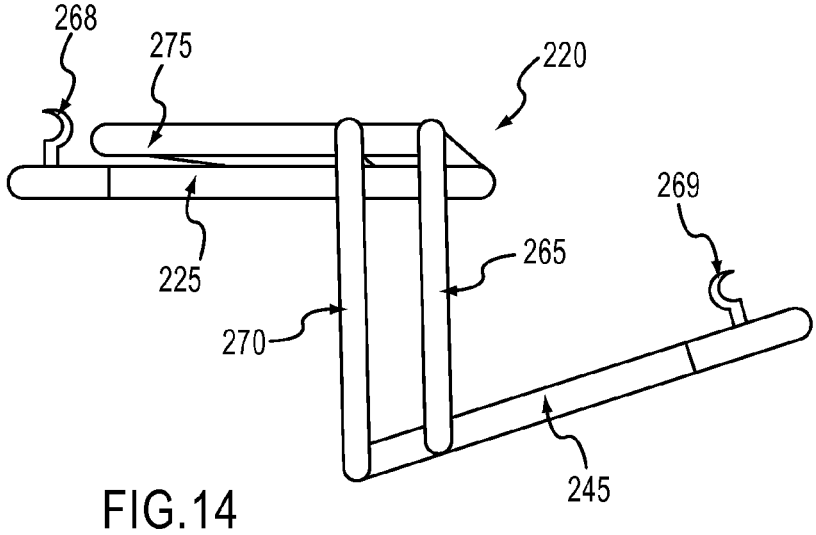

The pivoting of the connection members 255, 260, 265 and 270 of the first side portion 223 cause the first end portion 221 to be moved towards the second end portion 222 of the frame 220. Specifically, as shown in FIGS. 13 and 14, the pivoting of the first and second connection members 255 and 260 of the first side portion 223 cause the first and second support members 225 and 230 of the first end portion 221 to be moved towards the elongate members 275. In other words, the first and second connection members 255 and 260 of the first side portion 223 are pivoted with respect to the first support member 225 of the first end portion 221 and the elongate member 275 of the first side portion 223.

Similarly, as shown in FIGS. 14 and 15, the pivoting of the third and fourth connection members 265 and 270 of the first side portion 223 cause the first and second support members 245 and 250 of the second end portion 222 to be moved towards the elongate member 275. Said differently, the third and fourth connection members 265 and 270 of the first side portion 223 are pivoted with respect to the first support member 245 of the second end portion 222 and the elongate member 275 of the first side portion 223.

The second side portion 224 of the frame 220 has similar components and function. Accordingly, members of the second side portion pivot or move with respect to one another in a similar manner as the first side portion 223 of the frame 220.

As best illustrated in FIG. 16, when the frame 220 is in the collapsed configuration, the first and second connection members 255 and 260 of the first side portion 223 as well as the first and second connection members 280 and 283 of the second side portion 224 nest or are disposed between the elongate member 275 of the first side portion 223 and the elongate member 292 of the second side portion 224. Additionally, when the frame 220 is in the collapsed configuration, the first and second connection members 255 and 260 of the first side portion 223 as well as the first and second connection members 280 and 283 of the second side portion 224 nest or are disposed between the first support member 225 of the first end portion 221 and the second support member 230 of the first end portion 222.

As best illustrated in FIG. 16, when the frame 220 is in the collapsed configuration, the support members 225, 230, 245 and 250 nest or are disposed between the third connection member 265 of the first side portion 223 and the third connection member 286 of the second side portion 224. Additionally, when the frame 220 is in the collapsed configuration, the support members 225, 230, 245 and 250 nest or are disposed between the fourth connection member 270 of the first side portion 223 and the fourth connection member 289 of the second side portion 224.

Figure 20:
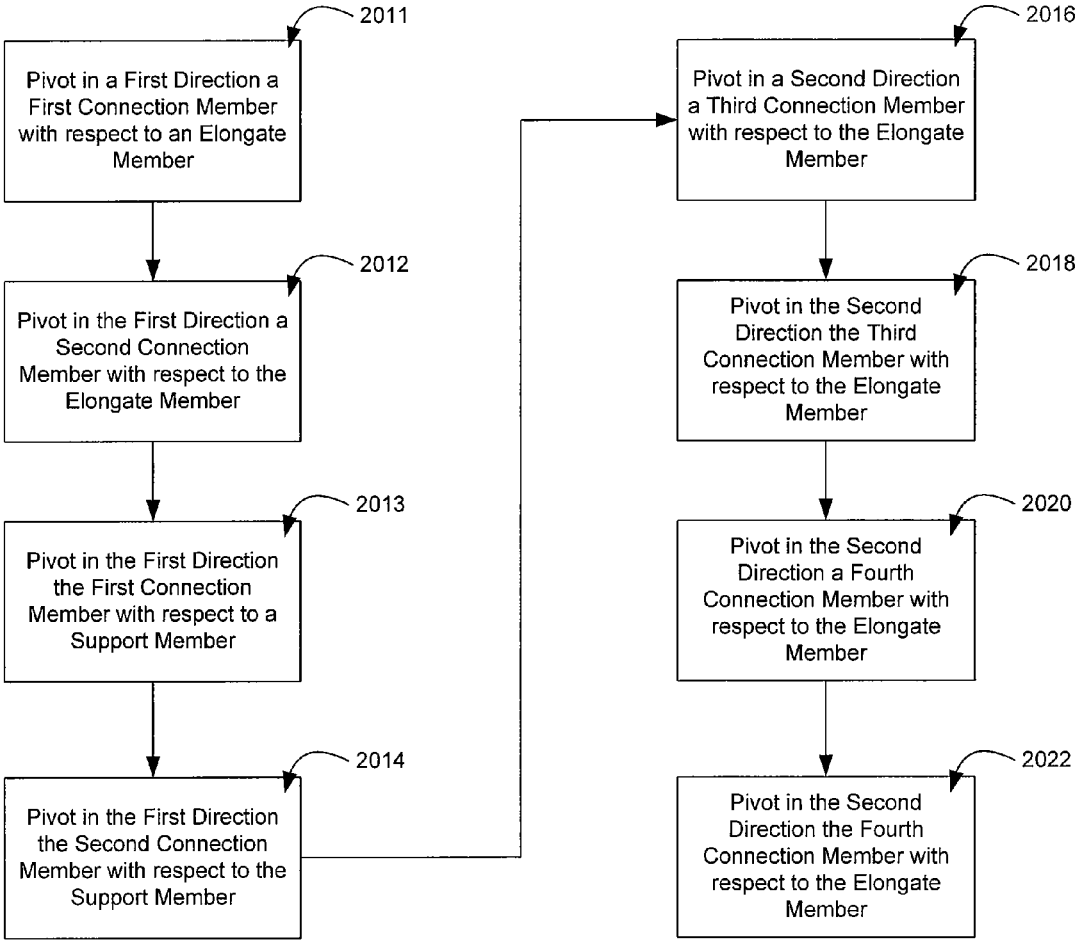
FIG. 20 is a flowchart illustrating a method of moving the frame of FIG. 2 from a first configuration to a second configuration.

FIG. 20 is a flowchart illustrating a method of moving the frame of FIG. 2 from a first configuration (e.g., an expanded configuration) to a second configuration (e.g., a collapsed configuration). At 2011, the first connection member of the first side portion is pivoted in a first direction with respect to the elongate member of the first side portion. At 2012, the second connection member of the first side portion is pivoted in the first direction (e.g., a counterclockwise direction) with respect to the elongate member of the first side portion. At 2013, the first connection member of the first side portion is pivoted in the first direction with respect to the first support member of the first end portion. At 2014, the second connection member of the first side portion is pivoted in the first direction with respect to the first support member of the first end portion.

In this embodiment, after the first and second connection members of the first side portion are pivoted, the third and fourth connection members are pivoted. At 2016, the third connection member of the first side portion is pivoted in a second direction (e.g., a clockwise direction) opposite the first direction with respect to the elongate member of the first side portion. At 2018, the third connection member of the first side portion is pivoted in the second direction with respect to the first support member of the second end portion. At 2020, the fourth connection member of the first side portion is pivoted in the second direction with respect to the elongate member of the first side portion. At 2022, the fourth connection member of the first side portion is pivoted in the second direction with respect to the first support member of the second end portion.

In this embodiment, the first side portion of the frame and the second side portion of the frame are mirror images and include similar components. Accordingly, the first connection member of the second side portion is pivoted in the first direction with respect to the elongate member of the second side portion and with respect to the second support member of the first end portion. The second connection member of the second side portion is pivoted in the first direction with respect to the elongate member of the second side portion and with respect to the second support member of the first end portion. The third connection member of the second side portion is pivoted in the second direction with respect to the elongate member of the second side portion and with respect to the second support member of the second end portion. The fourth connection member of the second side portion is pivoted in the second direction with respect to the elongate member of the second side portion and with respect to the second support member of the second end portion.

In this embodiment, before the first and second connection members and of the first side portion are pivoted, the first support member of the first end portion is pivoted with respect to the second support member of the first end portion. Similarly, the first support member of the second end portion is pivoted with respect to the second support member of the second end portion.

In this embodiment, while the support members are being pivoted, the cross members are pivoted. Specifically, the first cross member is pivoted in a first direction with respect to the first support member of the first end portion. The first cross member is pivoted in a second direction with respect to the second support member of the first end portion. The second direction is opposite the first direction. Similarly, the second cross member can be pivoted with respect to the first and second support members of the second end portion.

In one embodiment, the first configuration is a collapsed configuration and the second configuration is an expanded configuration. In such an embodiment, the hammock member 210 can be coupled to the frame 220 when the frame 220 is in the expanded configuration.

As best illustrated in FIGS. 2 and 3, the first end portion 221 of the frame 220 includes a first hook 268 coupled to the first coupler 235. The first hook 268 is configured to couple to the hammock member 210. The second end portion 222 of the frame 220 includes a second hook 269 coupled to the second coupler 241. The second hook 269 is configured to couple to the hammock member 210. In an alternative embodiment, the first end portion and the second end portion of the frame do not include a hook. Rather, the first end portion and the second end portion of the frame are each coupled to the hammock member via a clip, nut and bolt, or any other coupling mechanism. In another alternative embodiment, the hammock member has a hook configured to couple to a hole defined by the frame or a chain coupled to the frame.

In the illustrated embodiment, the hammock member 210 of the support 200 is coupled to the hooks 268 and 269 of the frame 220, and is suspended between the hooks 268 and 269 when the frame 220 is in its deployed or expanded configuration as shown in FIG. 2. When the hammock member 210 is suspended between the hooks 268 and 269 of the frame 220, the hammock member 210 is configured to receive and support a user. As best illustrated in FIGS. 2 and 17-19, the hammock member 210 includes a membrane portion 211 and coupling portions 212 and 213.

As best illustrated in FIG. 2, in the illustrated embodiment, the hammock member 210 is darted at several regions, including a middle region 2006, a top region (not shown), and a bottom region 2008. At the darted regions 2006 and 2008, the material of the membrane portion 211 is collected near the edges of the membrane portion 211 and sewn. Thus, the center of the hammock member 210 includes more fabric than the edges of the hammock member 210, allowing hammock member 210 to have a cup-like form to receive the user.

In this embodiment, the membrane portion 211 is a layer of material, such as a layer of nylon or neoprene, or any other material of sufficient strength to support a user. In an alternative embodiment, the membrane portion is several pieces of material that form a mesh or multiple layers of different materials.

Figure 17:
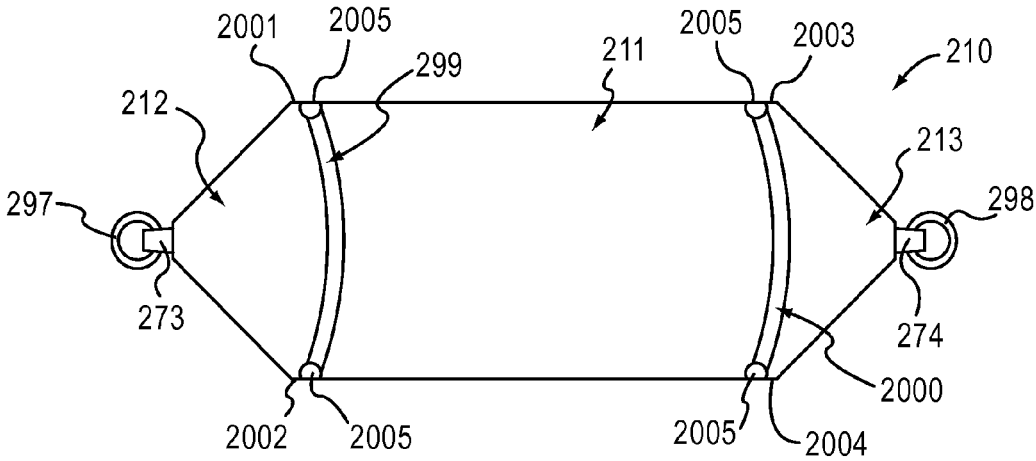
FIG. 17 is a bottom view of a hammock portion of the support device of FIG. 2.
Figure 18:
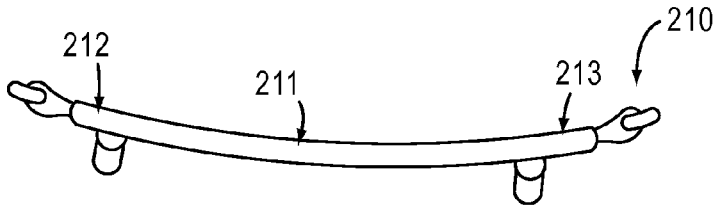
FIG. 18 is a side view of the hammock portion of the support device of FIG. 2.
Figure 19:
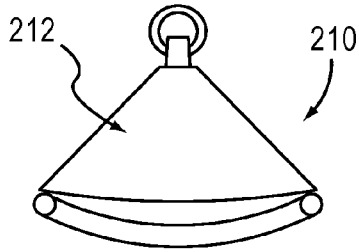
FIG. 19 is an end view of the hammock portion of the support device of FIG. 2.

As shown in FIG. 17, each of the coupling portions 212 and 213 has a coupling strap 273 and 274, respectively. The coupling straps 273 and 274 are coupled to coupling rings 297 and 298, respectively. The coupling straps 273 and 274 are respectively threaded through the coupling rings 297 and 298 and both ends of the coupling straps 273 and 274 are coupled to the hammock member 210. Although, in this embodiment, a hook-and-loop type mechanism is used to couple the coupling straps 273 and 274 to the hammock member 210, it should be understood that other coupling mechanisms can be used, such as, for example, clips, ball-and-sockets, etc.

In the illustrated embodiment, the coupling rings 273 and 274 interact with hooks 268 and 269, which are coupled to the couplers 235 and 241 of the frame 220, respectively, to removably couple the hammock member 210 to the frame 220. In an alternative embodiment, the coupling ring interacts with another portion of the frame to removably or permanently couple the hammock member to the frame.

In alternative embodiments, the coupling portions of the hammock member have coupling lines that are sewn to the membrane portion and are removably tied to the end portions of the frame. In another alternative embodiment, the coupling lines are tied to the membrane portion. In yet another alternative embodiment, the coupling lines are coupled to the membrane portion via glue, staples, or any other known coupling mechanism. In further alternative embodiments, the coupling lines are coupled to the end portions of the frame, respectively, via a clip, a hook, a snap, or any other known coupling mechanism. In a further alternative embodiment, the coupling portions do not include coupling lines and the membrane portion and the coupling portions are a single continuous piece of material. In yet a further alternative embodiment, the membrane portion includes grommets, which interact with the hooks to removably couple the hammock member to the frame.

As best illustrated in FIGS. 2 and 17, the hammock member 210 also includes cross members 299 and 2000. The cross members 299 and 2000 provide support to the hammock member 210. Specifically, the cross members 299 and 2000 retain the hammock member 210 in a spread or open configuration. Cross member 299 is coupled to, and extends between, corners 2001 and 2002 of the hammock member 120. Similarly, cross member 2000 is coupled to, and extends between, corners 2003 and 2004 of the hammock member 210. In the illustrated embodiment, the cross members 299 and 2000 are coupled to the underside of the hammock member 210 and are of a bent or a non-linear configuration. Thus, in the illustrated embodiment, the ends of the cross members 299 and 2000 contact the membrane portion 211 while the mid-portions of the support members do not contact the membrane portion 211. At the mid-point of the cross members 299 and 2000, the support members can be, for example, approximately 2 to 6 inches below the membrane portion 211.

In this embodiment, pockets 2005 are disposed on the underside of the hammock member 210, and receive and couple the ends of the cross members 299 and 2000 to the hammock member 210. In other embodiments, other conventional means, such as sewing or hook-and-loop type mechanisms, are used to removably or permanently couple the cross members to the membrane portion.

In the illustrated embodiment, the cross members 299 and 2000 are hollow, metal tubes, such as steel tubes. Alternatively, the cross members 299 and 2000 can be formed of any material and configured in any cross-sectional shape that provides sufficient structural strength to retain the hammock member 210 in a spread or open configuration. For example, the cross members 299 and 2000 can be aluminum tubes, plastic tubes, solid metal or plastic bars, or wooden bars.

In some embodiments, the membrane portion of the hammock member has a head pillow and/or a leg pillow. The head pillow is disposable at a position to support the head or neck of a user. The head pillow can include an outer shell and filling material disposed within the shell. In other embodiments, the head pillow is an inflatable pillow. The outer shell and/or the hammock member include a coupling mechanism that allows the head pillow to be removably coupled to the hammock member. For example, the outer shell and the hammock member my include a hook-and-loop type coupling mechanism, a snap type coupling mechanism, or any other type of non-permanent coupling mechanism. In an alternative embodiment, the head pillow is fixedly and permanently coupled to the hammock member.

Similar to the head pillow, in some embodiments, a leg pillow is disposable at a position to support the legs of a user. The leg pillow includes an outer shell and filling material disposed within the shell. In an alternative embodiment, the leg pillow is an inflatable pillow. One, or both, of the outer shell and the hammock member include a coupling mechanism that allows the leg pillow to be removably coupled to the hammock member. For example, the outer shell and the hammock member may include a hook-and-loop type coupling mechanism, a snap type coupling mechanism, or any other type of non-permanent coupling mechanism. In an alternative embodiment, the leg pillow is fixedly and permanently coupled to the hammock member.

In some embodiments, pockets are disposed on the underside of the hammock member, and receive and couple the ends of the cross members to the hammock member. In other embodiments, other known mechanisms, such as sewing or hook-and-loop type mechanisms, are used to removably or permanently couple the cross members to the hammock member.

In some embodiments, the hammock member of the support also includes a beverage pocket and a book pocket. The beverage pocket includes an opening in the hammock member and a receiver portion that is disposed adjacent to, and communicates with, the opening in the hammock member. The receiver portion includes a lower support portion. Thus, a beverage container may be placed in, and supported by, the beverage pocket.

In some embodiments, the receiver portion is sewn to the hammock member. In alternative embodiments, the receiver portion is coupled to the hammock member via another coupling mechanism, such as a hook-and-loop type mechanism.

In some embodiments, the receiver portion of the beverage pocket is made of a single piece of fabric or any other material that would provide the enough strength to support a beverage container. In another embodiment, the receiver portion of the beverage pocket is made of a several pieces of material.

In some embodiments, the book pocket of the hammock member includes an opening in the hammock member and a receiver portion that is disposed adjacent to, and communicates with, the opening in the hammock member. The receiver portion includes a lower support portion. Thus, a book, a magazine, or other reading material may be placed in, and supported by, the book pocket. In such embodiments, a lower support portion is coupled to the hammock member. Thus, when a book or other reading material is placed in the book pocket, the book or reading material is disposed in a parallel relationship to the hammock member.

In some embodiments, the receiver portion is sewn to the hammock member. In alternative embodiments, the receiver portion is coupled to the hammock member via another coupling mechanism, such as a hook-and-loop type mechanism.

In some embodiments, the receiver portion of the book pocket is made of a single piece of fabric or any other material that would provide the enough strength to support a book or other reading material. In another embodiment, the receiver portion of the book pocket is made of a several pieces of material.

In some embodiments, the support includes a shade member includes tethering lines, a membrane portion, and a frame member. The tethering lines are coupled to, and extend between a first end of the membrane portion and the hammock member of the support. Conventional means, such as a releasable coupler, may be used to releasably couple the tethering lines to the first end of the membrane portion and to the hammock member. Alternatively, the first end of the membrane portion and the hammock member may include openings and the tethering lines may be tied to the membrane portion and to the hammock portion. In a further alternative embodiment, the tethering lines may be coupled to, and extend between, the frame portion of the support and the first end of the membrane portion. In another embodiment, a single tethering line is used.

In some embodiments, the support members can telescope between a compact and an extended configuration. In such embodiments, the frame can include wheels coupled to the frame. This "telescoping" arrangement of the support members allows the support members to be placed in an extended, or lengthened, configuration and in a contracted, or shortened, configuration. When in the extended, or lengthened, configuration, the telescoping arrangement allows the frame of the support to fully extend to the intended height, thereby positioning the hammock member sufficiently above the support surface (e.g., the ground). When in the contracted, or shortened configuration the telescoping arrangement allows for compact transportation of the support.

In some embodiments, wheels are rotatably coupled to the second end portion of the frame. The wheels are configured to roll along a support surface to transport the support when the frame is disposed in its expanded configuration and/or its collapsed configuration. In one embodiment, the wheels have locking mechanisms to lock the wheels so as to prevent them from rotating. In alternative embodiments, however, the wheels are coupled to different portions of the support, such as to the side portions or to the first end portion.

In some embodiments, a support strap is coupled to, and extends between, the first side portion of the frame and the second side portion of the frame. The support strap provides support to the frame when the frame is in its expanded configuration. Specifically, the support strap is configured to prevent the first side portion from bowing away from the second side portion when the frame is disposed in its expanded configuration.

While various embodiments of the invention have been described above, it should be understood that they have been presented by way of example only, and not limitation. While specific embodiments have been shown and described, it will be understood that various changes in form and details may be made.

In some embodiments, the frame can include more connection members to extend the length of the frame. For example, some embodiments can have more than the three segments illustrated in FIG. 2 (the first segment includes the first and second connection members of the first side portion and the second side portion; the second segment includes the elongate members of the first side portion and the second side portion; the third segment includes the third and fourth connection members of the first side portion and the second side portion). In such embodiments, an additional segment can include multiple connection members coupled between the support members of the first end portion and the connection members of the first segment to extend the length of the frame. In other alternative embodiments, the frame can include fewer connections members to shorten the length of the frame.

In yet other alternative embodiments, the second connection member of the first side portion can be coupled to a mid-portion of the first support member of the first end portion rather than being coupled to the second end portion of the first support member of the first end portion of the frame (see, e.g., connection member 242). Similarly, the second connection member of the second side portion can be coupled to a mid-portion of the second support member of the first end portion rather than being coupled to the second end portion of the second support member of the first end portion of the frame (see, e.g., connection member 244). Similarly, the fourth connection members of the first side portion and the fourth connection member of the second side portion can be coupled to a mid-portion of the first and second support members of the second end portion of the frame, respectively, rather than being coupled to the second end portion of the frame (see, e.g., connection members 258 and 259).

In yet other alternative embodiments, the first end portion of the frame includes more than two support members such that the first end portion of the frame is self supporting. Similarly, the second end portion of the frame includes more than two support members such that the second end portion of the frame is self supporting. In such embodiments, the frame need not include the second side portion. In other words, in such alternative embodiments, a single structure (similar to the first side portion or the second side portion) can be located along the center of the frame and each end portion can include a support member to couple to the hammock member and two or more support members that contact the ground. For example, the two or more support members can be horizontally disposed to provide stability to the frame. Alternatively, the two or more support members can be vertical or slanted with respect to the ground in a tripod-like structure to provide stability to the frame.

What is claimed is:

1. An apparatus, comprising:

a frame having an expanded configuration and a collapsed configuration, the frame including, a support member having a first end portion and a second end portion opposite the first end portion, a first elongate member having a first end portion and a second end portion opposite the first end portion, the first end portion of the first elongate member being pivotally coupled to the second end portion of the support member, a second elongate member having a first end portion and a second end portion opposite the first end portion, the first end portion of the second elongate member being pivotally coupled to the support member, and a third elongate member having a first end portion and a second end portion, the second end portion of the second elongate member being pivotally coupled to the first end portion of the third elongate member, the second end portion of the first elongate member being pivotally coupled to the third elongate member between the first end portion and the second end portion of the third elongate member, the third elongate member being substantially parallel to a support surface when the frame is in its expanded configuration, the support member and the first elongate member being substantially parallel to the second elongate member when the frame is in the collapsed configuration.

2. The apparatus of claim 1, wherein the frame further includes a fourth elongate member having a first end portion and a second end portion opposite the first end portion of the fourth elongate member, the first end portion of the fourth elongate member being pivotally coupled to the third elongate member.

3. The apparatus of claim 1, wherein the support member is a first support member, the frame further includes a fourth elongate member having a first end portion and a second end portion opposite the first end portion of the fourth elongate member, the first end portion of the fourth elongate member being pivotally coupled to the third elongate member, and a second support member having a first end portion and a second end portion opposite the first end portion of the second support member, the second end portion of the second support member being pivotally coupled to the second end portion of the fourth elongate member, the first end portion of the second support member being configured to couple to a hammock member.

4. The apparatus of claim 1, wherein the support member is a first support member, the frame further includes a fourth elongate member having a first end portion and a second end portion opposite the first end portion of the fourth elongate member, the first end portion of the fourth elongate member being pivotally coupled to the second end portion of the third elongate member, and a second support member being pivotally coupled to the second end portion of the fourth elongate member.

5. The apparatus of claim 1, wherein the support member is a first support member, the frame further includes a second support member pivotally coupled to the first end portion of the first support member.

6. The apparatus of claim 1, further comprising:

a hammock member removably coupled to the first end portion of the support member when the frame is in the expanded configuration, the hammock member including a hammock membrane having a first side portion and a second side portion opposite the first side portion, the hammock member including a cross member having a first end portion and a second end portion opposite the first end portion, the cross member having a curved configuration, the first end portion of the cross member being coupled to the first side portion of the hammock membrane, the second end portion of the cross member being coupled to the second side portion of the hammock membrane.

7. The apparatus of claim 1, further comprising:

a hook coupled to the first end portion of the support member and configured to engage a hammock member.

8. An apparatus, comprising:

a frame having an expanded configuration and a collapsed configuration, the frame including, an elongate member having a first side portion and a second side portion opposite the first side portion, the elongate member being substantially parallel to a support surface and elevated above the support surface when the frame is in its expanded configuration, a first connection member pivotally coupled to the first side portion of the elongate member, a second connection member pivotally coupled to the second side portion of the elongate member, a first support member pivotally coupled to the first connection member, the first support member being configured to couple to a hammock member, and a second support member pivotally coupled to the second connection member, the second support member being configured to couple to the hammock member, the first support member being substantially parallel to the first connection member and to the second support member when the frame is in the collapsed configuration.

9. The apparatus of claim 8, wherein the frame defines a longitudinal axis, the first connection member being disposed between the elongate member and the longitudinal axis, the first connection member being disposed between the first support member and the longitudinal axis.

10. The apparatus of claim 8, wherein the frame defines a longitudinal axis, the elongate member being disposed between the second connection member and the longitudinal axis, the second support member being disposed between the second connection member and the longitudinal axis.

11. The apparatus of claim 8, wherein the frame further includes a third connection member pivotally coupled to the first side portion of the elongate member and pivotally coupled to the first support member.

12. The apparatus of claim 8, wherein the frame further includes a third connection member pivotally coupled to the second side portion of the elongate member and pivotally coupled to the second support member.

13. The apparatus of claim 8, wherein the elongate member is a first elongate member, the frame further includes a second elongate member having a first side portion and a second side portion opposite the first side portion of the second elongate member;

a third connection member pivotally coupled to the first side portion of the second elongate member;

a fourth connection member pivotally coupled to the second side portion of the second elongate member;

a third support member pivotally coupled the third connection member; and a fourth support member pivotally coupled to the fourth connection member, the first elongate member and the second elongate member being disposed between the second connection member and the fourth connection member, the first connection member and the third connection member being disposed between the first elongate member and the second elongate member.

14. The apparatus of claim 8, wherein the first side portion of the elongate member is an inner side portion of the elongate member, and the second side portion of the elongate member is an outer side portion of the elongate member.

15. A method, comprising:

pivoting a first connection member relative to an elongate member and relative to a support member such that the first connection member is rotated in a direction toward the elongate member, a first end portion of the first connection member being pivotally coupled to the support member, a second end portion of the first connection member being pivotally coupled to the elongate member such that a first side of the elongate member is disposed between the second end portion of the first connection member and a second side of the elongate member; and pivoting a second connection member relative to the elongate member and relative to the support member such that the second connection member is rotated in the direction toward the elongate member, a first end portion of the second connection member being pivotally coupled to the support member, a second end portion of the second connection member being pivotally coupled to the elongate member such that the first side of the elongate member is disposed between the second end portion of the second connection member and the second side of the elongate member.

16. The method of claim 15, wherein the support member is a first support member, the direction is a first direction, the method further comprising:

pivoting a third connection member relative to the elongate member such that the third connection member is rotated in a second direction toward the elongate member, the second direction being different than the first direction, a first end portion of the third connection member being pivotally coupled to a second support member, a second end portion of the third connection member being pivotally coupled to the elongate member.

17. The method of claim 15, wherein the support member is a first support member, the direction is a first direction, the method further comprising:

pivoting a third connection member relative to the elongate member such that the third connection member is rotated in a second direction toward the elongate member, the second direction being different than the first direction; and pivoting a fourth connection member with respect to the elongate member, the fourth connection member being pivotally coupled to the elongate member and pivotally coupled to a second support member.

18. The method of claim 15, wherein the support member is a first support member, the elongate member is a first elongate member, the method further comprising:

pivoting a third connection member with respect to a second elongate member, the third connection member being pivotally coupled to the second elongate member and pivotally coupled to a second support member; and pivoting a fourth connection member with respect to the second elongate member, the fourth connection member being pivotally coupled to the second elongate member and pivotally coupled to the second support member.

19. The method of claim 15, wherein the support member is a first support member, the method further comprising:

pivoting the first support member with respect to a second support member, the second support member being pivotally coupled to the first support member.

20. The method of claim 15, wherein the support member is a first support member, the method further comprising:

pivoting the first support member with respect to a second support member, the second support member being pivotally coupled to the first support member; and simultaneously with the pivoting the first support member, pivoting a support cross member with respect to the first support member, the support cross member being coupled to the first support member and being coupled to the second support member.

* * * * *